US008308278B2

(12) United States Patent
Jones

(10) Patent No.: US 8,308,278 B2
(45) Date of Patent: Nov. 13, 2012

(54) SYSTEM AND METHOD FOR OPERATING A CONDUIT TO TRANSPORT FLUID THROUGH THE CONDUIT

(75) Inventor: Brent R. Jones, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 243 days.

(21) Appl. No.: 12/753,559

(22) Filed: Apr. 2, 2010

(65) Prior Publication Data

US 2011/0242234 A1 Oct. 6, 2011

(51) Int. Cl.
*B41J 2/175* (2006.01)

(52) U.S. Cl. ..... 347/85; 347/84; 347/86; 347/88

(58) Field of Classification Search ..... 347/84–88
See application file for complete search history.

(56) References Cited

U.S. PATENT DOCUMENTS

| | | | | |
|---|---|---|---|---|
| 3,516,455 | A | 6/1970 | Carter | |
| 3,591,319 | A | 7/1971 | Shlisky | |
| 3,881,846 | A | 5/1975 | Kashmerick | |
| 4,234,885 | A | 11/1980 | Arway | |
| 4,403,229 | A | 9/1983 | Barteck | |
| 4,540,350 | A | 9/1985 | Streicher | |
| 4,607,261 | A | 8/1986 | McCann et al. | |
| 4,735,557 | A | 4/1988 | Neumuller et al. | |
| 5,033,943 | A | 7/1991 | Durrum et al. | |
| 5,088,522 | A | 2/1992 | Rath et al. | |
| 5,098,221 | A | 3/1992 | Osborne | |
| 5,159,348 | A | 10/1992 | Dietl et al. | |
| 5,557,305 | A | 9/1996 | Hine et al. | |
| 5,724,082 | A | 3/1998 | Moynihan | |
| 6,003,733 | A | 12/1999 | Wheeler | |
| 6,137,513 | A * | 10/2000 | Pawlowski et al. | 347/86 |
| 6,203,146 | B1 * | 3/2001 | Pawlowksi et al. | 347/85 |
| 6,290,343 | B1 | 9/2001 | Lewis et al. | |
| 6,383,329 | B1 | 5/2002 | Agarwala et al. | |
| 6,481,837 | B1 | 11/2002 | Askren et al. | |
| 6,824,241 | B2 | 11/2004 | Sonnichsen et al. | |
| 6,860,591 | B2 | 3/2005 | Slotto et al. | |
| 7,114,801 | B2 | 10/2006 | Hall et al. | |
| 7,168,798 | B2 * | 1/2007 | Samii et al. | 347/86 |
| 7,195,624 | B2 | 3/2007 | Lockwood et al. | |
| 7,325,909 | B2 | 2/2008 | Yuen | |
| 7,507,099 | B2 | 3/2009 | Cowgill et al. | |
| 7,651,010 | B2 | 1/2010 | Orzech et al. | |
| 7,753,512 | B2 * | 7/2010 | Jones et al. | 347/88 |

(Continued)

FOREIGN PATENT DOCUMENTS

| | | |
|---|---|---|
| EP | 0178880 A1 | 4/1986 |

(Continued)

*Primary Examiner* — Matthew Luu
*Assistant Examiner* — Rut Patel
(74) *Attorney, Agent, or Firm* — Maginot, Moore & Beck, LLP

(57) ABSTRACT

A fluid transport apparatus facilitates flow of fluid from a source to a receptacle. The fluid transport apparatus includes a fluid transport conduit for transporting fluid, the fluid transport conduit having an inlet end that is coupled to a fluid supply and an outlet end that is coupled to a receptacle, a deforming member positioned proximate the fluid transport conduit and configured to deform a portion of the fluid transport conduit selectively and propel fluid through the fluid transport conduit, and a restoring member positioned proximate the fluid transport conduit and configured to exert a force against the fluid transport conduit that opposes the deforming of the fluid transport conduit.

16 Claims, 9 Drawing Sheets

U.S. PATENT DOCUMENTS

| | | | | |
|---|---|---|---|---|
| 8,075,090 | B2 * | 12/2011 | Karppinen et al. | 347/33 |
| 8,109,596 | B2 * | 2/2012 | Karppinen | 347/22 |
| 2003/0038865 | A1 | 2/2003 | Inamura | |
| 2003/0122904 | A1 | 7/2003 | Matsumoto | |
| 2004/0141023 | A1 | 7/2004 | Nakamura | |
| 2005/0012792 | A1 | 1/2005 | Kumagai et al. | |
| 2005/0046681 | A1 | 3/2005 | Kumagai et al. | |
| 2007/0081055 | A1 * | 4/2007 | Karppinen et al. | 347/85 |
| 2008/0055377 | A1 | 3/2008 | Jones et al. | |
| 2008/0149189 | A1 * | 6/2008 | Jones et al. | 137/334 |
| 2010/0276018 | A1 * | 11/2010 | Jones et al. | 137/565.01 |
| 2011/0018948 | A1 * | 1/2011 | Justice et al. | 347/86 |

FOREIGN PATENT DOCUMENTS

| | | | |
|---|---|---|---|
| EP | 0933217 | A2 | 4/1999 |
| EP | 1543980 | A1 | 6/2005 |
| WO | WO 88/08514 | A1 | 11/1988 |

* cited by examiner

SYSTEM AND METHOD FOR OPERATING A CONDUIT TO TRANSPORT FLUID THROUGH THE CONDUIT

TECHNICAL FIELD

This disclosure relates generally to machines that pump fluid from a supply source to a receptacle, and more particularly, to machines that repetitively deform a conduit to move the fluid.

BACKGROUND

Fluid transport systems are well known and used in a number of applications. For example, ink may be transported from a supply to one or more printheads in a printer and medicines may be delivered from a liquid source to a port for ejection into a patient, to name only two known applications. One method of moving fluids in these known systems is a peristaltic pump. A peristaltic pump typically includes a pair of rotors through which a delivery conduit is stationed. The rotation of the rotors under the driving force of a motor squeezes the delivery conduit in a delivery direction. As an amount of the fluid is pushed in the delivery direction, the supply continues to fill the delivery conduit so fluid is continuously pumped through the delivery conduit to the ejection port.

One issue that arises from the use of peristaltic pumps is the repetitive squeezing of the conduit. As the rotors rotate, they typically force the walls of the conduit closely together before allowing them to rebound. As the number of times that a short length of the conduit is collapsed and expanded increases, the life of the conduit is adversely impacted. One way of addressing this risk of a shortened life cycle for the conduit is to use materials for the conduit that are more resilient than those commonly used for fluid conduits, such as silicone elastomers. Unfortunately, the more resilient materials are expensive and in some applications cost competition is intense.

Other methods used in systems for delivering fluid through a conduit include the provision of a reservoir with a bladder located in the reservoir. The bladder is coupled between an inlet valve and an outlet valve. The bladder is cyclically filled with a gas to pump fluid out of the reservoir and then vented before commencement of the next cycle. Another method injects a compressed gas into an enclosed reservoir to urge fluid from the reservoir. The pressure in the enclosed reservoir is continually increased until the fluid supply in the reservoir is essentially exhausted. In response to a low level in the reservoir being sensed, the gas injection is terminated and the pressure in the reservoir is vented so the reservoir may be replenished or replaced. After replenishment or replacement, compressed gas is again introduced into the reservoir to move fluid into and through a conduit. The pumps used in these various methods to pressurize a reservoir or internal reservoir chamber, however, are generally expensive or bulky for some applications.

As noted above, some printers use a fluid transport system to move liquid ink from a reservoir to a printhead. One such type of printer is a solid ink or phase change printer. This type of printer conventionally uses ink in a solid form, either as pellets or as ink sticks. The solid ink is typically provided in cyan, yellow, magenta and black colors. The solid ink forms are inserted into feed channels, one for each color of ink used in the printer. Each feed channel may be constructed with an opening that accepts sticks of only one particular configuration. This structure helps reduce the risk of an ink stick having a particular characteristic from being inserted into the wrong channel.

After the ink sticks are fed into their corresponding feed channels, they are urged by gravity or a mechanical actuator to a heater assembly of the printer. The heater assembly includes a heater that converts electrical energy into heat and a melt plate. The melt plate is typically formed from aluminum or other lightweight material in the shape of a plate or an open sided funnel. The heater is proximate to the melt plate to heat the melt plate to a temperature that melts an ink stick coming into contact with the melt plate. The melt plate may be tilted with respect to the solid ink channel so that as the solid ink impinging on the melt plate changes phase, the melted ink drips into the reservoir for that color. The ink stored in the reservoir continues to be heated while awaiting subsequent use.

Each reservoir of colored, liquid ink may be coupled to a printhead through at least one manifold pathway. The liquid ink is pulled from the reservoir as the printhead demands ink for jetting onto a receiving medium or image drum. The printhead inkjet ejectors, which are typically piezoelectric devices, receive the liquid ink and expel the ink onto an imaging surface as a controller selectively activates the piezoelectric devices with a driving voltage. Specifically, the liquid ink flows from the reservoirs through manifolds to be ejected from microscopic orifices by piezoelectric devices in the printhead.

As throughput rates for liquid ink printheads increase, so does the need for delivering adequate amounts of liquid ink to the printhead. One problem arising from higher throughput rates is increased sensitivity to resistance and pressures in the printhead flow path. Restricted ink flow can limit or decrease imaging speed. In systems having filtration systems for filtering the liquid ink between the reservoir and a printhead piezoelectric device, the flow may also change over time and become insufficient to draw liquid ink to the printhead in sufficient amounts to provide the desired print quality.

One way of addressing the issue of flow resistance is to increase the filter area. The increased filter area decreases the pressure drop required to migrate a volume of ink through the filter. Increasing the filter area, however, also increases the cost of the printer as filtration material is often expensive. Moreover, the space for a larger filter may not be available as space in the vicinity of a printhead of in a phase change printer is not always readily available.

Another way of overcoming flow resistance as well as increased volume demand with fast imaging is to pressurize the liquid ink to force the ink through a restrictive flow path. One known method of pressurizing a fluid in a conduit is to use a peristaltic pump. As noted above, peristaltic pumps may adversely impact the life of the conduit. Consumers of solid ink printers are sensitive to price and the use of peristaltic pumps with more expensive conduit material may negatively impact pricing of the printers.

The other methods for pressurizing fluid in a conduit noted above also pose tradeoffs in solid ink printer manufacture. For example, inclusion of the reservoir and reservoir arrangement noted above may require extensive modification of some existing printer designs to accommodate the pump operating parameters. If the arrangement of existing components is too extensive, then other limitations may arise, such as space constraints.

SUMMARY

A fluid transporting apparatus has been developed that selectively compresses and decompresses a conduit to deliver fluid from a fluid supply to a receptacle for the fluid while better preserving the operational life of the conduit. The fluid transporting apparatus includes a fluid transport conduit for transporting fluid, the fluid transport conduit having an inlet end that receives fluid from a fluid supply and an outlet end that delivers the fluid to a receptacle, a deforming member positioned proximate the fluid transport conduit and configured to deform a portion of the fluid transport conduit selectively and propel fluid through the fluid transport conduit, and a restoring member positioned proximate the fluid transport conduit and configured to exert a force against the fluid transport conduit that opposes the deforming of the fluid transport conduit.

A fluid transporting apparatus of this type may be incorporated in a phase change ink imaging device, such as a printer, multi-function product, packaging marker, or other imaging device or subsystem, to facilitate flow of melted ink to a printhead reservoir. These imaging devices are referred to as printers below for convenience. An improved phase change ink imaging device includes a melting device configured to melt solid ink sticks to produce melted ink, a melted ink collector configured to collect melted ink produced by the melting device, a melted ink transport apparatus configured to transport melted ink from the melted ink collector, a melted ink reservoir configured to store melted ink received from the melted ink transport apparatus, a printhead for receiving melted ink from the melted ink reservoir. The melted ink transport apparatus in this imaging device further includes a fluid transport conduit for transporting fluid, the fluid transport conduit having an inlet end that receives fluid from a fluid supply and an outlet end that delivers the fluid to a receptacle, a deforming member positioned proximate the fluid transport conduit and configured to deform a portion of the fluid transport conduit selectively and propel fluid through the fluid transport conduit, and a restoring member positioned proximate the fluid transport conduit and configured to exert a force against the fluid transport conduit that opposes the deforming of the fluid transport conduit.

BRIEF DESCRIPTION OF THE DRAWINGS

The foregoing aspects and other features of an fluid transport apparatus and an ink imaging device incorporating a fluid transport apparatus are explained in the following description, taken in connection with the accompanying drawings.

DETAILED DESCRIPTION

Figure 1:
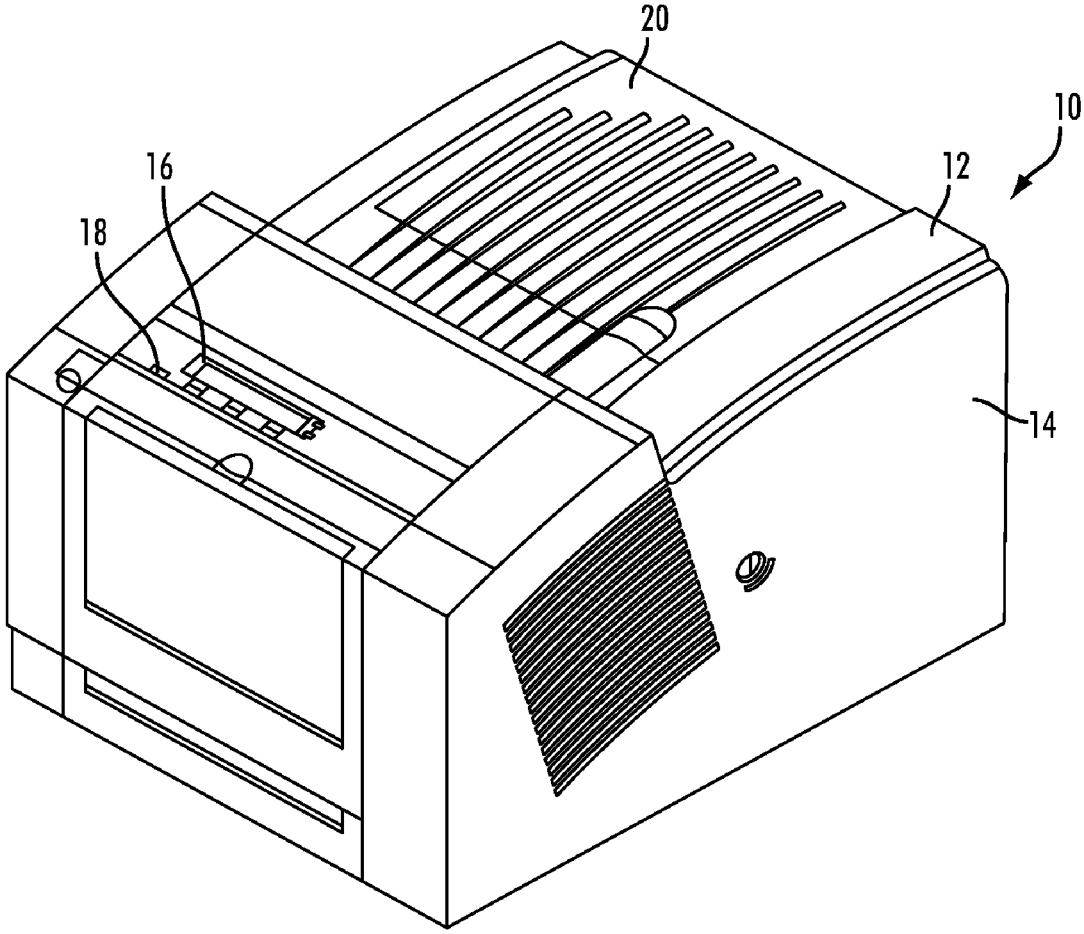
FIG. 1 is a perspective view of a phase change imaging device having a fluid transport apparatus described herein.

A perspective view of an ink printer 10 that incorporates a fluid transporting apparatus, which delivers melted ink to a reservoir with sufficient pressure to overcome the fluid resistance of a filter, is shown in FIG. 1. The reader should understand that the fluid transporting apparatus is disclosed as being in an embodiment of a solid ink printer, but the fluid transporting apparatus may be configured for use in other fluid transporting applications. Therefore, the fluid transporting apparatus discussed herein may be implemented in many alternate forms and variations. In addition, any suitable size, shape or type of components or materials may be used.

FIG. 1 shows an ink printer 10 that includes an outer housing having a top surface 12 and side surfaces 14. A user interface display, such as a front panel display screen 16, displays information concerning the status of the printer, and user instructions. Buttons 18 or other control actuators for controlling operation of the printer are adjacent the user interface window, or may be at other locations on the printer. An inkjet printing mechanism (FIG. 3) is contained inside the housing. A melted ink transporting apparatus collects melted ink from a melting device and delivers the melted ink to the printing mechanism. The melted ink transporting apparatus is contained under the top surface of the printer housing.

Figure 2:
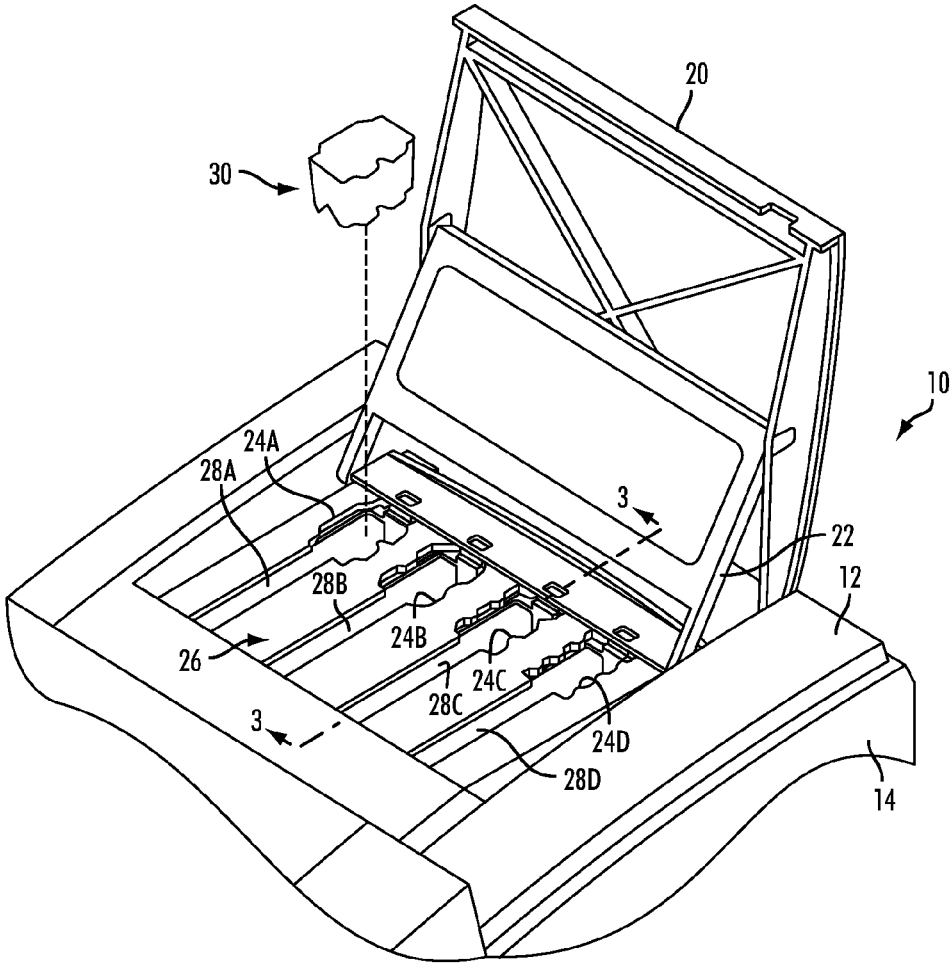
FIG. 2 is an enlarged partial top perspective view of the phase change imaging device with the ink access cover open, showing a solid ink stick in position to be loaded into a feed channel.

The top surface of the housing may include a hinged ink access cover 20 that opens as shown in FIG. 2 to provide the user access to the ink feed system. In the particular printer shown in FIG. 2, the ink access cover 20 is attached to an ink load linkage 22 so that the ink load linkage 22 slides and pivots to an ink load position in response to the printer ink access cover 20 being raised. As seen in FIG. 2, opening the ink access cover reveals a key plate 26 having keyed openings 24A-D. Each keyed opening 24A, 24B, 24C, 24D provides access to an insertion end of one of several individual feed channels 28A, 28B, 28C, 28D of the solid ink feed system.

A color printer typically uses four colors of ink (yellow, cyan, magenta, and black). Ink sticks 30 of each color are delivered through one of the feed channels 28A-D having the appropriately keyed opening 24A-D that corresponds to the shape of the colored ink stick. The operator of the printer exercises care to avoid inserting ink sticks of one color into a feed channel for a different color. Ink sticks may be so saturated with color dye that a printer user may have difficulty distinguishing colors from visual inspection alone. Cyan, magenta, and black ink sticks in particular can be difficult to distinguish based on color appearance. The key plate 26 has keyed openings 24A, 24B, 24C, 24D to aid the printer user in ensuring that only ink sticks of the proper color are inserted into each feed channel. Each keyed opening 24A, 24B, 24C, 24D of the key plate has a unique shape. The ink sticks 30 of the color for that feed channel have a shape corresponding to the shape of the keyed opening. The keyed openings and corresponding ink stick shapes exclude from each ink feed channel ink sticks of all colors except the ink sticks of the proper color for that feed channel.

Figure 3:
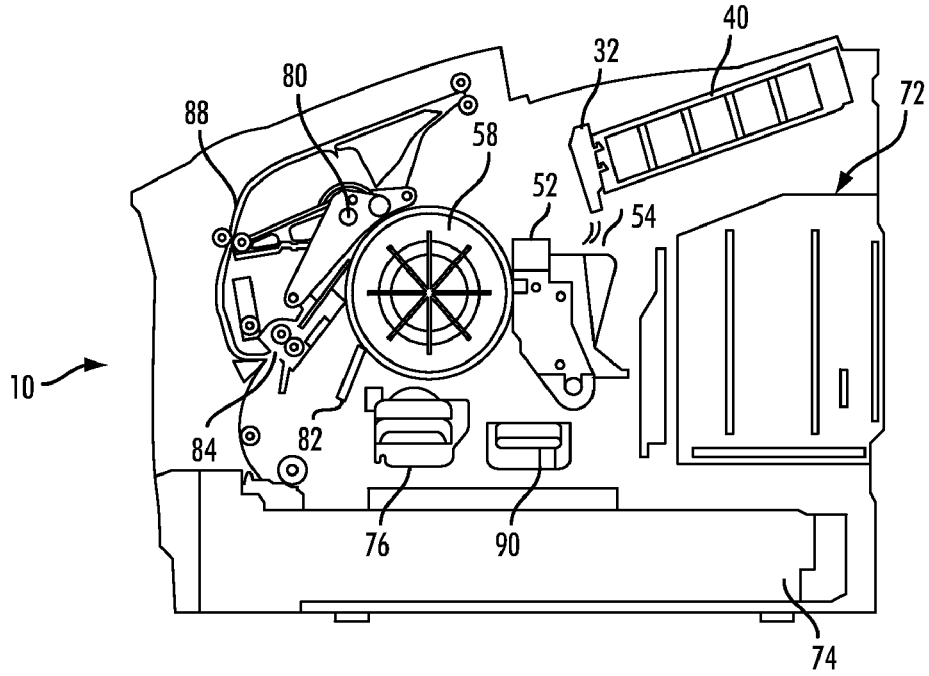
FIG. 3 is a side view of the ink printer shown in FIG. 2 depicting the major subsystems of the ink imaging device as they might appear with the side enclosure removed.

As shown in FIG. 3, the ink printer 10 may include an ink loading subsystem 40, an electronics module 72, a paper/media tray 74, a printhead 52, an intermediate imaging member 58, a drum maintenance subsystem 76, a transfer subsystem 80, a wiper subassembly 82, a paper/media preheater 84, a duplex print path 88, and an ink waste tray 90. In brief, solid ink sticks 30 are loaded into channels of the ink loader 40 through which they travel to a solid ink stick melting chamber 32. At the melting chamber, the ink stick is melted and the liquid ink is pumped through a transport conduit 54, in a manner described below, to a reservoir for storage before being delivered to inkjet ejectors in the printhead 52. The ink is ejected by piezoelectric transducers through apertures to form an image on the intermediate imaging member 58 as the member rotates. An intermediate imaging member heater is controlled by a controller in the electronics module 72 to maintain the imaging member within an optimal temperature range for generating an ink image and transferring it to a sheet of recording media. A sheet of recording media is removed from the paper/media tray 74 and directed into the paper pre-heater 84 so the sheet of recording media is heated to a more optimal temperature for receiving the ink image. Recording media movement between the transfer roller in the transfer subsystem 80 and the intermediate image member 58 is coordinated for the phasing and transfer of the image.

Figure 4:
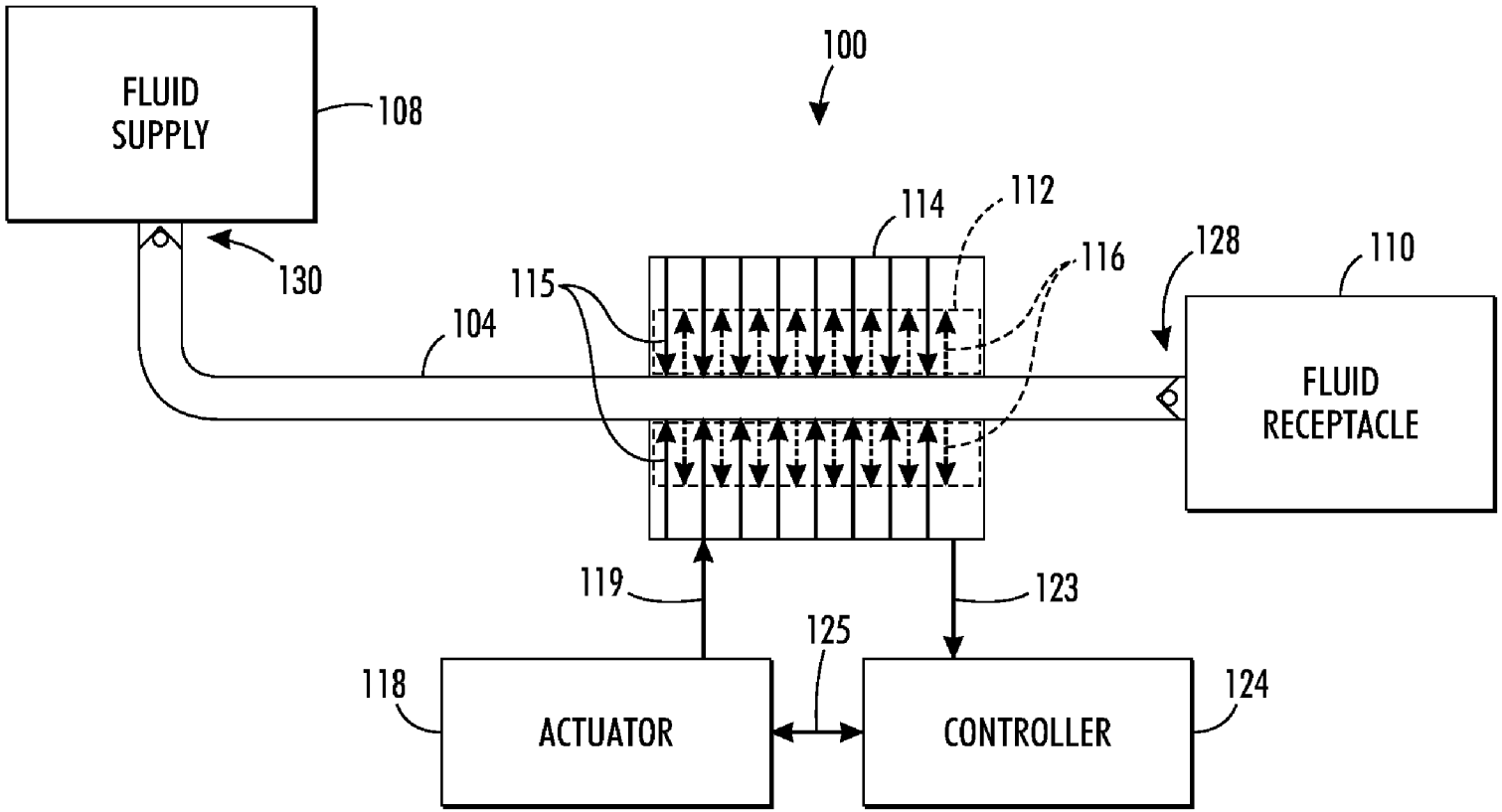
FIG. 4 is a schematic view of a fluid transporting apparatus.

As discussed above, the melted ink is pumped through a fluid transport conduit to a reservoir for storage before being delivered to a printhead. A schematic view of one embodiment of a fluid transporting apparatus 100 is shown in FIG. 4. The apparatus includes a fluid transport conduit 104 having its inlet coupled to a fluid supply 108 and its outlet coupled to a fluid receptacle 110. A deforming member 114 is proximate to a portion of the fluid transport conduit 104. A restoring member 112 is also proximate to a portion of the fluid transport conduit 104. A controller 124 operates an actuator 118 to move the deforming member 114, as indicated by an arrow 119. The controller 124 may receive feedback signals from the actuator 118, as indicated by a double arrow 125. The controller 124 may also receive feedback signals from the deforming member 114, as indicated by an arrow 123. The actuator 118 may be a motor that turns a camshaft or drives a fixed or variable displacement pump. The camshaft rotation operates the deforming member 114 with reciprocating motion, while the operation of the pump selectively pressurizes and produces a negative pressure within the restoring member 112.

The fluid transporting apparatus 100 implements a pumping method that deforms the fluid transport conduit 104 without completely collapsing the fluid transport conduit 104. The deformation of the conduit 104 drives fluid from the conduit in one phase of the pumping cycle and the return of the conduit to its original form draws fluid from the fluid supply 108 into the fluid transport conduit 104 in another phase of the pumping cycle.

In the systems described in this document, the restoring member 112 aids in the return of the fluid transport conduit 104 to its original shape. This action helps pull fluid into the conduit from the fluid supply 108 and overcomes any reduction in rebound due to chemical degradation and/or aging of the fluid transport conduit 104. A check valve 128 may be provided at the outlet of the fluid transport conduit 104 to block fluid from entering the conduit from the fluid receptacle 110. Likewise, a check valve 130 may be coupled to the inlet of the fluid transport conduit 104 to prevent fluid in the fluid transport conduit 104 from re-entering the fluid supply 108.

Because the compression and decompression of the fluid transport conduit 104 in the fluid transporting apparatus 100 occurs along a portion of the fluid transport conduit 104 that is longer than a typical section of conduit pinched by a typical peristaltic pump, the flexing of the conduit wall need not be as extensive as required with a peristaltic pump. The reduction in conduit wall compression and decompression also helps extend the life of the conduit.

Figure 5:
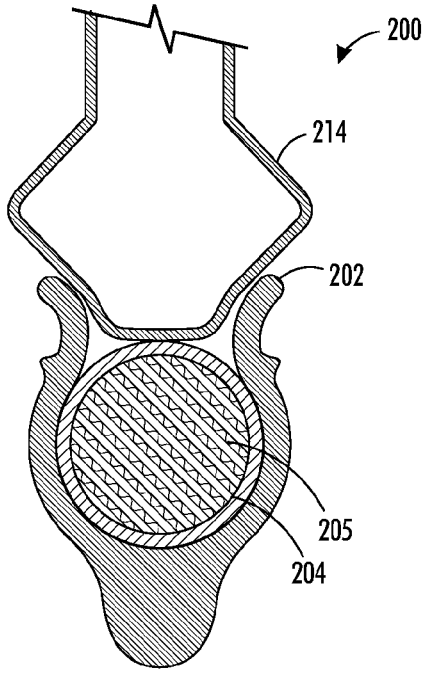
FIG. 5 is an exemplary embodiment of a fluid transport system that may be used in the apparatus of FIG. 4, depicted in a deactuated position.
Figure 6:
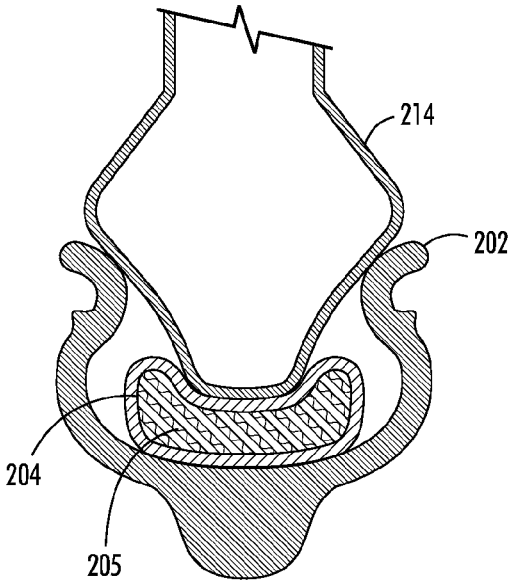
FIG. 6 is the exemplary embodiment of the fluid transport system of FIG. 5, depicted in an actuated position.

An exemplary embodiment of a fluid transport system 200 is shown in FIG. 5 that may be used in the fluid transporting apparatus 100, shown in FIG. 4. The fluid transport system 200 includes a deforming member 214, a pair of resilient arms 202, and a fluid transport conduit 204 carrying a fluid 205 therein. A downward movement of the deforming member 214, as shown in FIG. 6, applies forces to the fluid transport conduit 204 causing the conduit to deform and the pair of resilient arms 202 to deflect outwardly and accommodate the deformed conduit 204. Two arms have been described in the disclosed embodiment; however, one or more constraining resilient arms may be configured to function as a conduit restoring force by returning to a constraining position when the deforming member is withdrawn or relaxed.

The downward movement of the deforming member 214 is part of a reciprocating action of the deforming member 214. This downward movement may be generated by a camshaft that is rotated by a motor (not shown). The cams on the camshaft enable a series of deforming members to operate on a number of independent conduits. The reciprocating movement of the deforming member 214 may also be performed with linear motion rather than the eccentric movement of a camshaft.

Figure 7:
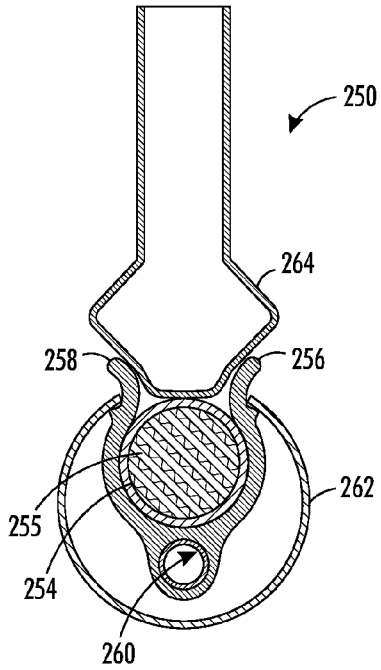
FIG. 7 is an exemplary embodiment of another fluid transport system that may be used in the apparatus of FIG. 4, depicted in a deactuated position.
Figure 8:
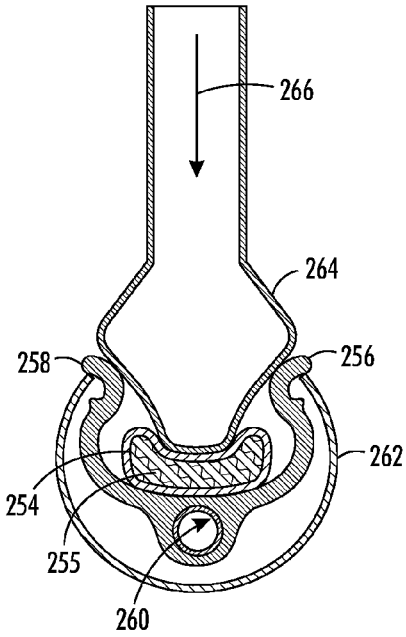
FIG. 8 is the exemplary embodiment of the fluid transport system of FIG. 7, depicted in an actuated position.

Another exemplary embodiment of a fluid transport system 250 is shown in FIG. 7 that may be used in the fluid transporting apparatus 100, shown in FIG. 4. The fluid transport system 250 includes a deforming member 264, arms 256 and 258, a pivot 260, a spring 262, and a fluid transport conduit 254 carrying a fluid 255 therein. The spring 262 urges the arms 256 and 258 towards one another to the position depicted in FIG. 7. The arms 256 and 258 are hinged with respect to one another by the pivot 260. Downward movement of the deforming member 264, as shown in FIG. 8, compresses the fluid transport conduit 254 and urges the arms 256 and 258 to separate. As the deforming member 214 returns to its original position, spring 262 moves the arms 256 and 258 towards each other to restore conduit 254 to its relaxed state. In this case the arms are rigid or semi-rigid and may be mirror image configurations or, as with the resilient restoring example of FIG. 5, one or any reasonable number of jointed arms may be used. One example would be an opposing scissors-like configuration. In other embodiments, conduit restoring articulation arms may move or be constrained within a desired movement range by structures that enable movement other than pivoting, such as sliding movement.

Figure 9:
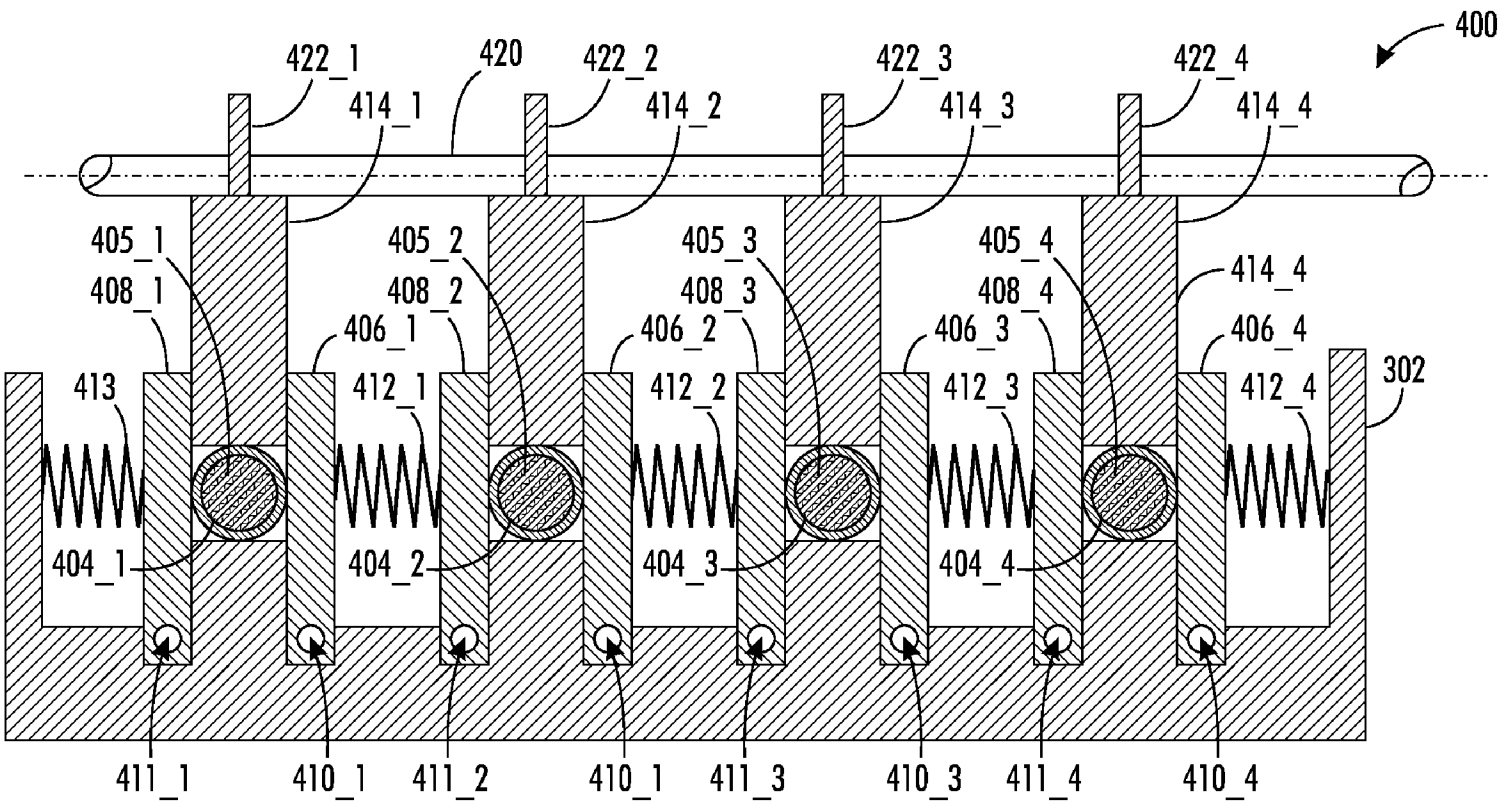
FIG. 9 is an exemplary embodiment of another fluid transport system that may be used in the apparatus of FIG. 4.

An exemplary embodiment of a fluid transport system 400 is shown in FIG. 9 that may be used in the fluid transporting apparatus 100, shown in FIG. 4. In the description of the fluid transport system 400 that is provided below, the index "i" indicates values in the range of 1-n, where n is the number of conduits being controlled by the system. In the system of FIG. 9, i can be in a range of 1-4. The fluid transport system 400 includes a housing 302, deforming members 414_*i*, arms 406_*i* and 408_*i*, pivots 410_*i* and 411_*i*, springs 412_*i* and 413, fluid transport conduit 404_*i* that transport fluid 405_*i*, a shaft 420, and cams 422_*i*. The springs 412_*i* and 413 urge the arms 406_*i* and 408_*i* to the position depicted in FIG. 9. The arms 406_*i* and 408_*i* are hinged with respect to the housing 302 by the pivot 410_*i* and 411_*i*. Rotation of the shaft 420, e.g., by a motor (not shown), rotates the cams 422_*i*. Rotations of the cams 422_*i* cause the deforming members 414_*i* to reciprocate. Downward movement of the deforming members 414_*i* compresses the fluid transport conduit 404_*i* to propel fluid through the conduits. As the deforming members are moved upwardly by the rotation of the cams, the springs urge the arms against the conduits to restore the conduits to their original form. The cams may be positioned on the shaft 320 to operate the conduits in unison or the cams may be eccentrically positioned on the shaft to phase the operation of the conduits.

In the embodiments described above, the deforming member is rigid member that acts on a straight section of the fluid transporting conduit. In other embodiments, the deforming member may also be curved to operate upon a curved portion of a conduit. Consequently, the fluid transport system is not limited to environments in which a relatively straight section of conduit is available for manipulation, but in environments where the conduit bends and turns provided a containment member can be configured to accommodate the conduit as the curved deforming member acts on the curved portion. The containment member can be pivoted, hinged, and biased as described above to aid in the restoration of the fluid conduit.

Figure 10:
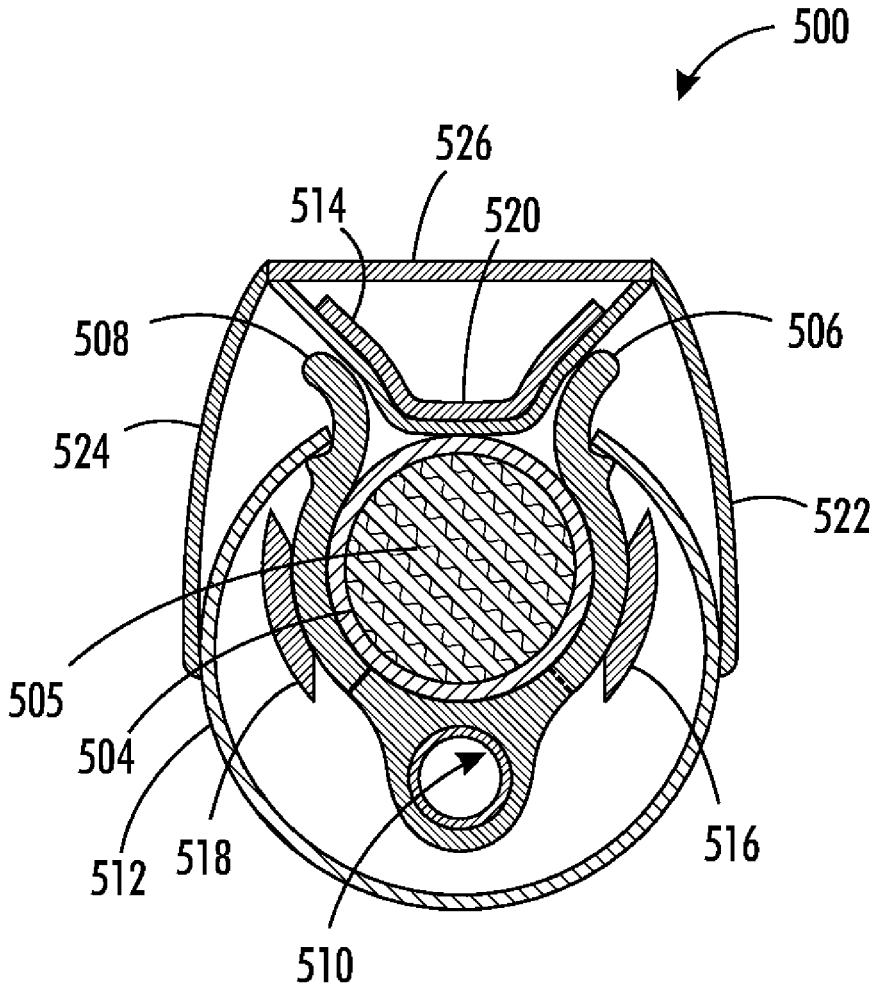
FIG. 10 is an exemplary embodiment of another fluid transport system that may be used in the apparatus of FIG. 4 that is capable of regulating a temperature of the fluid transported by the system.

In certain applications, fluid inside a fluid transport conduit may need to be maintained within a predetermined temperature range. An exemplary embodiment of a fluid transport system 500 is shown in FIG. 10 that may be used in the fluid transporting apparatus 100, shown in FIG. 4. The fluid transport system 500 includes a deforming member 514, arms 506 and 508, a pivot 510, a spring 512, a fluid transport conduit 504 that transports a fluid 505, heaters 516, 518, and 520, thermal sleeves 522, and 524, and a thermal interface 526. Operation of the fluid transport system 500 is similar to the fluid transport system 250. However, in the fluid transport system 500 thermal provisions maintain the fluid 505 inside the fluid transport conduit 504 within a predetermined range. Thermal sensors (not shown) can be used to monitor the temperature of the fluid 505 and transmit the temperature to the controller 124 along the signal path designated by the arrow 123 in FIG. 4. In response to the temperature signal(s), the controller 124 activates and deactivates the heaters 516, 518, and 520 in order to maintain the fluid temperature within a predetermined temperature range. While the embodiment shown in FIG. 10 has been described as using heaters to heat the fluid in the conduits, cooling devices may be similarly situated on the device and operated by the controller to maintain the fluid in the conduit in a predetermined temperature range by regulation of the cooling devices.

Figure 11:
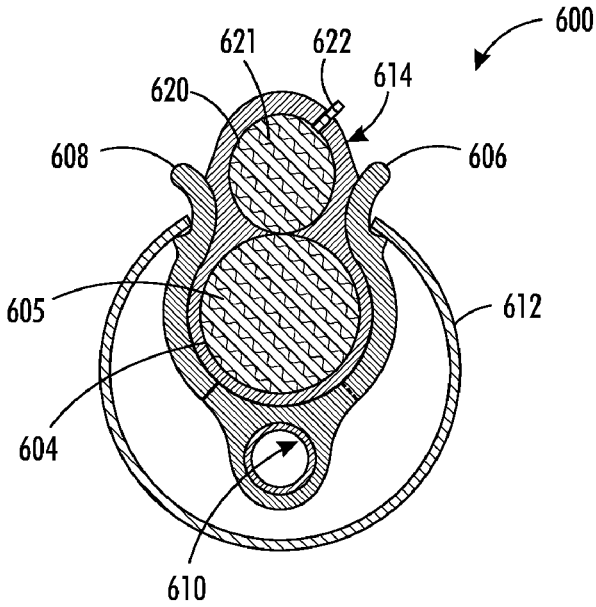
FIG. 11 is an exemplary embodiment of another fluid transport system that may be used in the apparatus of FIG. 4, depicted in a deactuated position.
Figure 12:
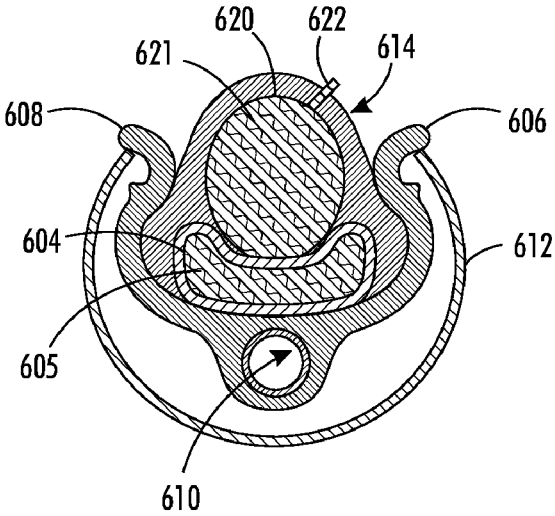
FIG. 12 is the exemplary embodiment of the fluid transport system of FIG. 11, depicted in an actuated position.

An exemplary embodiment of a fluid transport system 600 is shown in FIG. 11 that compresses and restores the fluid conduits with fluid forces. The fluid transport system 600 includes a deforming member 614 which includes a compressor conduit 620 that is filled with a fluid 621 and a fluid valve 622, arms 606 and 608, a pivot 610, a spring 612, and a fluid transport conduit 604 that transports a fluid 605. The spring 612 is coupled to the arms 606 and 608 to urge the arms towards one another. The arms 606 and 608 are hinged together by the pivot 610. By pressurizing the fluid 621 inside the compressor conduit 620, the compressor conduit 620 expands and applies compressive force against the fluid transport conduit 604 to deform it, as shown in FIG. 12. At the same time, the arms 606 and 608 deflect outwardly to accommodate the expansion of the deforming member 614 and the deformation of the fluid transport conduit 604. By opening the valve 622 to release the pressurized fluid 621 from the compressor conduit 620, the fluid transport conduit 604 is urged back to its original shape by the action of the spring 612 on the arms 604 and 608. In cooperation with the spring 612, or in place of the spring 612, the valve 622 can be connected to a vacuum to generate a negative fluid pressure inside the compressor conduit 620 to enable the fluid transport conduit 604 to return to its original shape. In a configuration in which a negative pressure source is coupled to the compressor conduit 620, the fluid transport conduit 604 is mounted within the compressor conduit. This structure enables the negative pressure to act directly on the fluid conduit 604 to aid in the restoration of the fluid conduit. In such a configuration, arms 606, 608 and spring 612 may be present or removed.

A printer configured with one of the fluid transport systems described above is able to provide melted ink to a printhead with a pumping action that lengthens the operational life of the fluid carrying conduits. The example printer would include a melting device configured to melt solid ink sticks to produce melted ink, a melted ink collector configured to collect melted ink produced by the melting device, a melted ink transport apparatus configured to transport melted ink from the melted ink collector, a melted ink reservoir configured to store melted ink received from the melted ink transport apparatus, and a printhead for receiving melted ink from the melted ink reservoir. The melted ink transport would include a fluid transport conduit for transporting fluid, the fluid transport conduit having an inlet end that receives fluid from a fluid supply and an outlet end that delivers the fluid to a receptacle, a deforming member positioned proximate the fluid transport conduit and configured to deform a portion of the fluid transport conduit selectively and propel fluid through the fluid transport conduit, and a restoring member positioned proximate the fluid transport conduit and configured to exert a force against the fluid transport conduit that opposes the deforming of the fluid transport conduit. The fluid transport system may also include heating or cooling devices to regulate the temperature of the melted ink as it travels through the conduits. Also, the fluid transport systems described above may be used in other applications where fluids are transported and where the benefit of a longer conduit life would be useful.

It will be appreciated that various of the above-disclosed and other features and functions, or alternatives thereof, may by desirably combined into many other different systems or applications. For example, conduit restoring arms or features may be continuous or discontinuous, as with gaps, "fingers", flex sections and the like and may be configured in one or more sections or arrays along the conduit. In another example, conduits and other elements of the fluid transporting apparatus may be of uniform or varying wall thicknesses. In one such instance, the conduits or other elements of the fluid transporting apparatus may have regions in which no deformation may occur. Also, that various presently unforeseen or unanticipated alternatives, modifications, variations or improvements therein may be subsequently made by those skilled in the art which are also intended to be encompassed by the following claims.

The invention claimed is:

1. A fluid transport apparatus comprising:

a fluid transport conduit for transporting fluid, the fluid transport conduit having an inlet end that receives fluid from a fluid supply and an outlet end that delivers the fluid to a receptacle;

a deforming member positioned proximate the fluid transport conduit and configured to deform a portion of the fluid transport conduit selectively and propel fluid through the fluid transport conduit; and a restoring member positioned proximate the fluid transport conduit and configured to exert a force against the fluid transport conduit that opposes the deforming of the fluid transport conduit, the restoring member including one or more constraining resilient arms that encompass a portion of an exterior of the fluid transport conduit.

2. The fluid transport apparatus of claim 1, the deforming member further comprising:

a reciprocating member.

3. The fluid transport apparatus of claim 1, the deforming member further comprising:

an eccentric cam.

4. The fluid transport apparatus of claim 1 further comprising:

a thermal device configured to maintain the fluid transport conduit in a predetermined temperature range.

5. The fluid transport apparatus of claim 4 wherein the thermal device is a heater.

6. The fluid transport apparatus of claim 4 wherein the thermal device is a cooler.

7. The fluid transport apparatus of claim 1, the deforming member further comprising:

a second conduit; and a fluid compressor operatively coupled to the second conduit to pressurize the second conduit to deform the fluid transport conduit.

8. The fluid transport apparatus of claim 7 wherein the fluid transport conduit is constrained by the second conduit, and the restoring member further comprising:

a negative pressure source operatively coupled to the second conduit to restore the fluid transport conduit.

9. A fluid transport apparatus comprising:

a fluid transport conduit for transporting fluid, the fluid transport conduit having an inlet end that receives fluid from a fluid supply and an outlet end that delivers the fluid to a receptacle;

a deforming member positioned proximate the fluid transport conduit and configured to deform a portion of the fluid transport conduit selectively and propel fluid through the fluid transport conduit; and a restoring member positioned proximate the fluid transport conduit and configured to exert a force against the fluid transport conduit that opposes the deforming of the fluid transport conduit, the restoring member including:

one or more articulating arms that are at least semi-rigid and that encompass a portion of an exterior of the fluid transport conduit;

a pivot constraining motion of the articulating arms; and a biasing member configured to bias the one or more articulating arms towards the fluid transport conduit.

10. The fluid transport apparatus of claim 9, the deforming member further comprising:

a reciprocating member.

11. The fluid transport apparatus of claim 9, the deforming member further comprising:

an eccentric cam.

12. The fluid transport apparatus of claim 9 further comprising:

a thermal device configured to maintain the fluid transport conduit in a predetermined temperature range.

13. The fluid transport apparatus of claim 12 wherein the thermal device is a heater.

14. The fluid transport apparatus of claim 12 wherein the thermal device is a cooler.

15. The fluid transport apparatus of claim 9, the deforming member further comprising:

a second conduit; and a fluid compressor operatively coupled to the second conduit to pressurize the second conduit to deform the fluid transport conduit.

16. The fluid transport apparatus of claim 14 wherein the fluid transport conduit is constrained by the second conduit, and the restoring member further comprising:

a negative pressure source operatively coupled to the second conduit to restore the fluid transport conduit.

* * * * *